US005585810A

United States Patent [19]

Tsuru et al.

[11] Patent Number: 5,585,810

[45] Date of Patent: Dec. 17, 1996

[54] ANTENNA UNIT

[75] Inventors: Teruhisa Tsuru; Harufumi Mandai, both of Nagaokakyo, Japan

[73] Assignee: Murata Manufacturing Co., Ltd., Japan

[21] Appl. No.: 637,429

[22] Filed: Apr. 25, 1996

Related U.S. Application Data

[63] Continuation of Ser. No. 238,361, May 5, 1994, abandoned.

[51] Int. Cl.[6] ..... H01Q 9/00

[52] U.S. Cl. ..... 343/745; 343/700 MS; 343/749; 343/750; 343/850

[58] Field of Search ..... 343/700 MS, 702, 343/745, 749, 750, 752, 829, 846, 850, 860, 861, 713; H01Q 9/00

[56] References Cited

U.S. PATENT DOCUMENTS

| | | | |
|---|---|---|---|
| 4,379,296 | 4/1983 | Farrar et al. | 343/829 X |
| 4,475,108 | 10/1984 | Moser | 343/700 MS |
| 4,529,987 | 7/1985 | Bhartia et al. | 343/700 MS |
| 4,701,763 | 10/1987 | Yamamoto et al. | 343/702 X |
| 4,789,866 | 12/1988 | Ohe et al. | 343/713 X |
| 4,800,392 | 1/1989 | Garay et al. | 343/702 X |
| 4,806,941 | 2/1989 | Knöchel et al. | 343/700 MS |
| 4,806,944 | 2/1989 | Jacomb-Hood | 343/745 |
| 5,001,778 | 3/1991 | Ushiyama et al. | 343/700 MS X |
| 5,148,181 | 9/1992 | Yokoyama et al. | 343/700 MS X |
| 5,164,738 | 11/1992 | Murray et al. | 343/702 X |
| 5,184,143 | 2/1993 | Marko | 343/702 X |
| 5,434,579 | 7/1995 | Kagoshima et al. | 343/700 MS |
| 5,510,802 | 4/1996 | Tsuru et al. | 343/700 MS |

FOREIGN PATENT DOCUMENTS

| | | | |
|---|---|---|---|
| 0246026 | 11/1987 | European Pat. Off. | H01Q 1/24 |
| 2553586 | 4/1985 | France | H01Q 5/01 |
| 2360216 | 12/1973 | Germany | H01Q 1/32 |

OTHER PUBLICATIONS

Patent Abstracts of Japan, vol. 10, No. 20 (E–376) (2077) 25 Jan. 1986 & JP–A–60 182 203 (Hitoshi Tokumaru) (Abstract).

K. Fujimoto, et al., Small Antennas, Research Studies Press Ltd., England, 1987.

I. J. Bahl, et al., Microstrip Antennas, Artech House, Inc. 1980.

*Primary Examiner*—Donald T. Hajec
*Assistant Examiner*—Steven Wigmore
*Attorney, Agent, or Firm*—Ostrolenk, Faber, Gerb & Soffen, LLP

[57] ABSTRACT

An antenna unit whose resonance frequency is switchable, the antenna unit including an antenna body (11) having a distributed inductance component ($L_1$), an impedance adjusting inductance component ($L_1$) and a capacitance ($C_1$) provided between the same and the ground potential, and a capacitor ($C_2$) and a diode ($D_1$) being connected in parallel with the capacitance ($C_1$) and in series with each other, so that a voltage for bringing the diode ($D_1$) into an ON or OFF state is applied to a node (16) between the capacitor ($C_2$) and the diode ($D_1$), thereby switching the resonance frequency of the antenna unit by switching ON and OFF states of the diode ($D_1$).

10 Claims, 6 Drawing Sheets

ANTENNA UNIT

This is a continuation of application Ser. No. 08/238,361 filed on May 5, 1994, now abandoned.

BACKGROUND OF THE INVENTION

1. Field of the Invention

The present invention relates to an antenna unit for high-frequency use, and more particularly, it relates to an antenna unit whose resonance frequency is switchable so that the same can be employed in a plurality of frequency bands.

2. Description of the Background Art

A smaller antenna unit is required for a mobile communicator. An inverted-F antenna unit is known as a type of miniature antenna unit which can be applied to such use.

An exemplary inverted-F antenna unit is described in "Small Antennas" by K. Fujimoro, A. Henderson, K. Hirasawa and J. R. James, Research Studies Press Ltd., England. An example of such an inverted-F antenna unit is now described with reference to FIG. 1. Referring to FIG. 1, an inverted-F antenna unit 1 has a rectangular metal plate 2 which serves as a radiating part. One side edge of the metal plate 2 is bent to be perpendicular to the metal plate 2, thereby forming a ground terminal 3. Another side edge of the metal plate 2 is also partially bent to form a feed terminal 4.

Due to the aforementioned structure, it is possible to mount the inverted-F antenna unit 1 on a printed circuit board by inserting the ground terminal 3 and the feed terminal 4 in through holes which are provided in the printed circuit board.

In conventional miniature antennas including the aforementioned inverted-F antenna unit, however, the bandwidth is so insufficient that the antenna can cover only a transmission or receiving side frequency band in application to a mobile communicator. But as shown in FIG. 2, when frequency bands Tx and Rx of transmission and receiving sides are separated from each other by a frequency A in a portable mobile communicator, a single antenna unit must have a bandwidth B, to enable both transmission and receiving. However, the conventional miniature antenna unit cannot satisfy such a bandwidth B.

In a system provided with transmission and receiving sides having the same frequency bandwidth such as the PHP (personal handy phone) system, it is possible to cover both the transmission and the receiving frequencies with the conventional miniature antenna unit for a mobile communicator. However, there has been no miniature antenna unit which can cover both the transmission and the receiving frequency bandwidths in a system provided with different transmission and receiving frequencies.

Thus, development of a miniature antenna unit whose resonance frequency is switchable has been awaited.

SUMMARY OF THE INVENTION

In order to satisfy the aforementioned requirement, an object of the present invention is to provide an antenna unit employing a miniature antenna having a relatively small bandwidth, whose resonance frequency is switchable.

According to a broad aspect of the present invention, provided is an antenna unit comprising an antenna body having a feed part and a part which is connected to the ground potential. Capacitance means is connected between the antenna body and the ground potential to be in parallel with an electrostatic capacitance which exists between the antenna unit and the ground potential, for adding an additional capacitance to the electrostatic capacitance in a parallel manner, and switching means is connected to the capacitance means for enabling change of the value of the additional capacitance of the capacitance means for switching the resonance frequency of the antenna unit.

According to the present invention, the capacitance of the capacitance means is changed by the switching means. Therefore, the capacitance of the capacitance means which is added to the electrostatic capacitance provided between the antenna body and the ground potential in a parallel manner is switched. On the other hand, the resonance frequency of the antenna unit is determined by the inductance value of an inductance component of the antenna body and the value of the capacitance between the antenna body and the ground potential. In the antenna unit according to the present invention, the capacitance of the capacitance means is changed by the switching means, whereby the resonance frequency of the antenna unit is switched.

Therefore, when the antenna body is formed by a miniature antenna having a small bandwidth, the inventive antenna unit can be properly applied to a system having different transmission and receiving frequencies since its resonance frequency is switchable.

In a specific aspect of the inventive antenna unit, the capacitance means has a capacitor and an element, whose own capacitance can be changed, which are connected in series with each other, while the switching means is connected to the element, for changing its capacitance. In this case, the capacitor is adapted to prevent a current which is supplied from the switching means from flowing toward the antenna body.

According to another specific aspect of the present invention, the element is formed by a diode, and the switching means is a voltage supply circuit for supplying a node between the capacitor and the diode with a first or second voltage for bringing the diode into an ON or OFF state. According to this structure, the diode enters a conducting state when the same is brought into an ON state, whereby the capacitance component of the overall antenna unit is determined by a capacitance which is obtained by connecting the electrostatic capacitance provided between the antenna body and the ground potential in parallel with the capacitance of the capacitor. When the diode is brought into an OFF state, on the other hand, the electrostatic capacitance of the diode itself is added in series with the capacitor. Therefore, the capacitance of the overall antenna unit is determined by a capacitance which is obtained by connecting the electrostatic capacitance provided between the antenna body and the ground potential in series with a series capacitance of the capacitor and the diode. Thus, the resonance frequency of the antenna unit is switched by bringing the diode into an ON or OFF state.

According to still another specific aspect of the present invention, the capacitance means has a first capacitor, a diode which is connected in series with the first capacitor and a second capacitor which is connected in series with the diode, and the switching means is formed by a voltage supply circuit which is so structured as to supply a first node between the first capacitor and the diode and a second node between the diode and the second capacitor with voltages being different in polarity from each other while capable of inverting the voltages supplied to the first and second nodes in polarity. According to this structure, the voltages which are supplied to the first and second nodes are inverted in polarity to bring the diode into an ON or OFF state, thereby switching the resonance frequency of the antenna unit.

The antenna body employed for the inventive antenna unit can be formed by a well-known rod antenna or the inverted-F antenna, while the same is preferably formed by an antenna body comprising a dielectric substrate, a ground electrode which is formed on at least one of a side surface and a bottom surface of the dielectric substrate, a radiator, consisting of a material having low conductor loss, which is so fixed to the dielectric substrate that its one major surface is opposed to an upper surface of the dielectric substrate, and a feed part which is provided on at least one of a side surface and a bottom surface of a laminate formed by the dielectric substrate and the radiator.

More preferably, the radiator comprises a radiating part having a rectangular plane shape, and at least one fixed part extending from at least one side edge of the radiating part toward the dielectric substrate, so that the at least one fixed part is fixed to the side surface of the dielectric substrate, thereby fixing the radiator to the dielectric substrate. Further preferably, a space of a prescribed thickness is defined between the radiating part and the upper surface of the dielectric substrate, thereby improving the gain of the antenna body. Further preferably, the capacitance means are formed in the dielectric substrate and in the space of a prescribed thickness.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
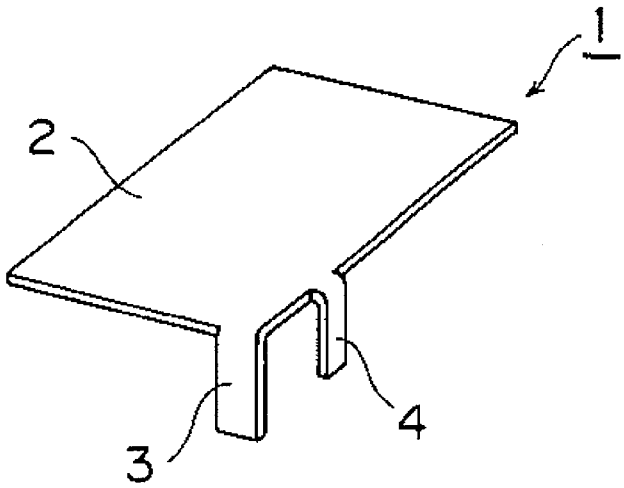
FIG.1 PRIOR ART
FIG. 1 is a perspective view showing a conventional inverted-F antenna.
Figure 2:
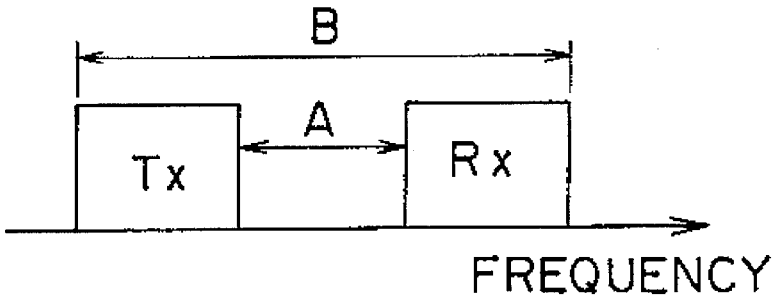
FIG. 2 is a typical diagram for illustrating a bandwidth required for an antenna in a system provided with different transmission and receiving frequencies.
Figure 3:
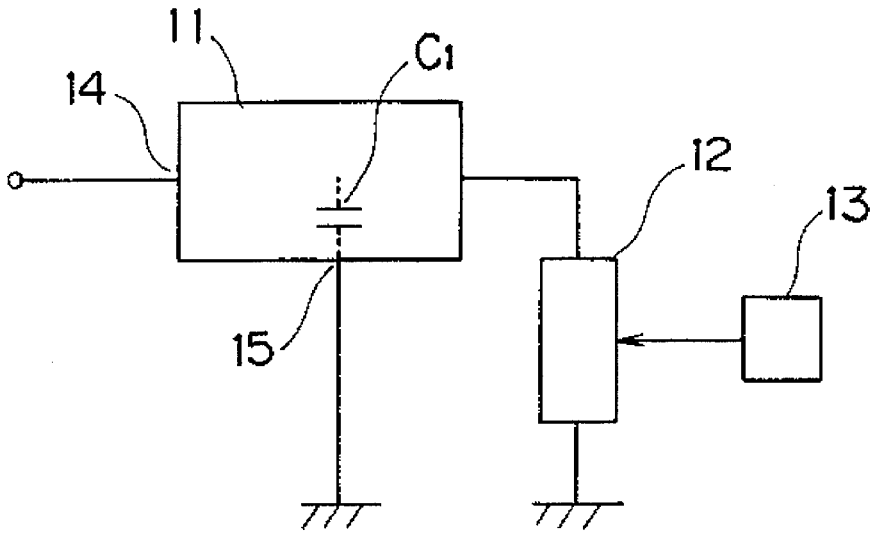
FIG. 3 is a schematic block diagram showing an antenna unit according to the present invention.

FIG. 3 is a schematic block diagram showing an antenna unit according to the present invention. This antenna unit comprises an antenna body 11 having a feed terminal F, capacitance means 12 which is connected to the antenna body 11, and switching means 13 for switching the capacitance of the capacitance means 12. The antenna body 11 has a feed part 14, and a part 15 which is connected to the ground potential. As shown by FIG. 3 in a broken line, the antenna body 11 has a capacitance $C_1$ between the same and the ground potential. This capacitance $C_1$ is formed by a distributed capacitance provided between either a capacitor element which is built into the antenna body 11 as described later in a concrete embodiment, and/or the antenna body 11, and the ground potential.

The capacitance means 12, which is connected between the antenna body 11 and the ground potential, is connected in parallel with the capacitance $C_1$. The capacitance means 12 is adapted to add a capacitance to the capacitance $C_1$ in a parallel manner, while its own capacitance can be switched by the switching means 13. Therefore, the total electrostatic capacitance between the antenna body 11 and the ground potential in this antenna unit is switched by switching the capacitance of the capacitance means 12 by the switching means 13.

In the antenna unit according to the present invention, therefore, it is possible to switch the resonance frequency by switching the capacitance of the capacitance means 12 by the switching means 13, whereby the antenna unit is employable in a plurality of bandwidths.

Figure 4:
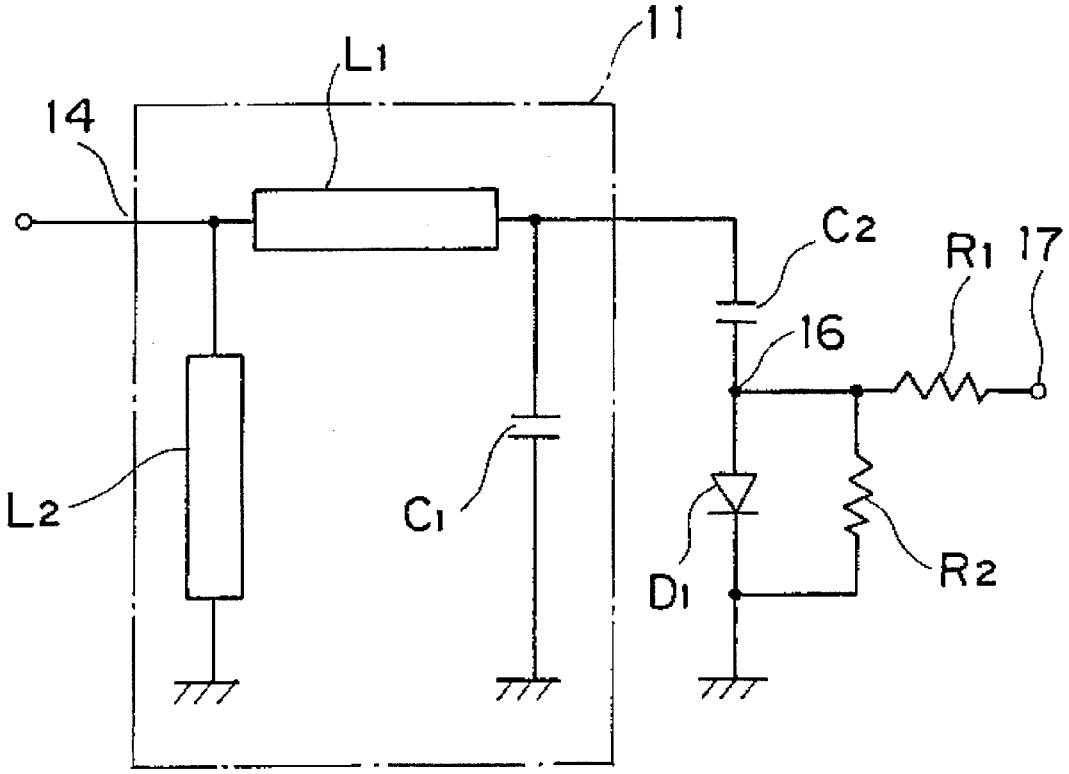
FIG. 4 is a circuit diagram of an antenna unit according to a first embodiment of the present invention.

FIG. 4 is a circuit diagram showing a first concrete embodiment of the inventive antenna unit shown in FIG. 3.

According to this embodiment, an antenna body 11 has a distributed inductance component $L_1$ of a part radiating electromagnetic waves, an impedance adjusting distributed inductance component $L_2$, and an electrostatic capacitance $C_1$. The capacitance $C_1$ is that provided between the antenna body 11 and the ground potential. The antenna body 11 may be provided therein with a capacitor element which is connected between the same and the earth potential for adjusting the resonance frequency, and the capacitance of this capacitor element also forms the capacitance $C_1$ in this case. When the antenna body 11 is provided with no such capacitor element, however, the capacitance $C_1$ is formed by a distributed capacitance between the antenna body 11 and the earth potential.

A capacitor $C_2$ and a diode $D_1$ are connected in series between the antenna body 11 and the earth potential. The capacitor $C_2$ and the diode $D_1$ form the aforementioned capacitance means 12. As clearly understood from FIG. 4, a capacitance formed by the capacitor $C_2$ and the diode $D_1$ is connected in parallel with the capacitance $C_1$ provided in the antenna body 11.

A resistance $R_1$ is connected between a node 16 between the capacitor element $C_2$ and the diode $D_1$, and an input terminal 17. Another resistance $R_2$ is connected between an end portion of the resistance $R_1$ which is opposite to that close to the input terminal 17 and the earth potential. The resistances $R_1$ and $R_2$ are adapted to divide a pulse voltage which is supplied from the input terminal 17, for supplying the node 16 with a pulse voltage of a proper value.

The pulse voltage which is supplied to the node 16 is set with reference to a threshold voltage of the diode $D_1$, so that the diode $D_1$ enters an ON state when the same is at a high level while the diode $D_1$ enters an OFF state when the same is at a low level. Further, the values of the resistances $R_1$ and $R_2$ are so selected as to supply the node 16 with the aforementioned pulse voltage for bringing the diode $D_1$ into an ON or OFF state.

The input terminal 17 is connected with a trigger pulse power source (not shown), to be supplied with the pulse voltage from this power source.

An operation of switching the resonance frequency in the antenna unit according to the embodiment shown in FIG. 4 is now described.

Assuming that $L_1$ and $L_2$ represent inductance values of the inductance components $L_1$ and $L_2$, and $C_1$ represents the capacitance value of the capacitance $C_1$, the resonance frequency $f_0$ of the antenna body 11 having the inductance components $L_1$ and $L_2$ and the capacitance $C_1$ is expressed as follows:

$$f_0 = 1/\{2\pi\sqrt{C_1(L_1+L_2)}\} \quad (1)$$

Thus, it is understood possible to move the resonance frequency $f_0$ by adjusting the capacitance $C_1$.

On the other hand, the capacitor $C_2$ and the diode $D_1$ are connected to the antenna body 11 according to this embodiment. Further, the capacitance means 12 which is formed by the capacitor $C_2$ and the diode $D_1$ is supplied with the pulse voltage through the resistances $R_1$ and $R_2$. When a high-level voltage is supplied from the input terminal 17, therefore, the diode $D_1$ is brought into an ON state, to enter a conducting state. Assuming that $C_2$ represents the capacitance value of the capacitor $C_2$, therefore, the resonance frequency $f_{ON}$ of the antenna unit expressed as follows, when the diode $D_1$ is in an ON state:

$$f_{ON} = 1/\{2\pi\sqrt{(C_1+C_2)(L_1+L_2)}\}$$

When a low-level voltage is applied from the input terminal 17, on the other hand, the diode $D_1$ enters an OFF state. Assuming that $C_D$ represents the electrostatic capacitance of the diode $D_1$ which is in a nonconducting state, the capacitance $C_X$ of the portion forming the capacitance means 12 is expressed as follows:

$$C_x = C_2C_D/(C_2+C_D) \quad (2)$$

Therefore, the resonance frequency $f_{OFF}$ of the antenna unit is expressed as follows, when the diode $D_1$ is in an OFF state:

$$f_{OFF} = 1/\{2\pi\sqrt{(C_1+CX)(L_1+L_2)}\} \quad (3)$$

Namely, only the capacitor $C_2$ is connected in parallel with the capacitance $C_1$ when the diode $D_1$ is brought into an ON state. Thus, the overall electrostatic capacitance of the capacitance means 12 which is connected in parallel with the capacitance $C_1$ is increased, and the overall resonance frequency is reduced.

When a low-level voltage is supplied from the input terminal 17, on the other hand, the diode $D_1$ is brought into an OFF state, and the capacitance $C_X$ is connected in parallel with the capacitance $C_1$. Therefore, the capacitance of the capacitance means 12 which is connected in parallel with the capacitor $C_1$ is reduced and the resonance frequency of the antenna unit is increased.

In the antenna unit according to this embodiment, therefore, its resonance frequency is switched when the aforementioned high- or low-level voltage is applied from the input terminal 17.

In a system provided with different transmission and receiving frequencies, the transmission frequency is generally set in a frequency region which is lower than that for the receiving frequency, since an amplifier for obtaining an output necessary for transmission can be more easily designed on a lower frequency side as compared with a higher frequency side. In the antenna unit according to this embodiment, therefore, a high-level voltage is preferably supplied from the input terminal 17 in transmission, to bring the diode $D_1$ into an ON state. In receiving, on the other hand, a low-level voltage is supplied to the input terminal 17, to bring the diode $D_1$ into an OFF state.

As hereinabove described, it is possible to switch the receiving frequency of the antenna unit according to this embodiment by switching the pulse voltage which is supplied from the input terminal 17. Thus, the antenna body 11 can be suitably applied to a system having different transmission and receiving frequencies. In this case, the antenna body 11 can be formed by an arbitrary antenna such as a well-known rod antenna or the inverted-F antenna. Thus, it is possible to readily provide a miniature antenna unit whose resonance frequency is switchable.

A concrete structural example of this embodiment is now described with reference to FIGS. 5 to 8.

Figure 5:
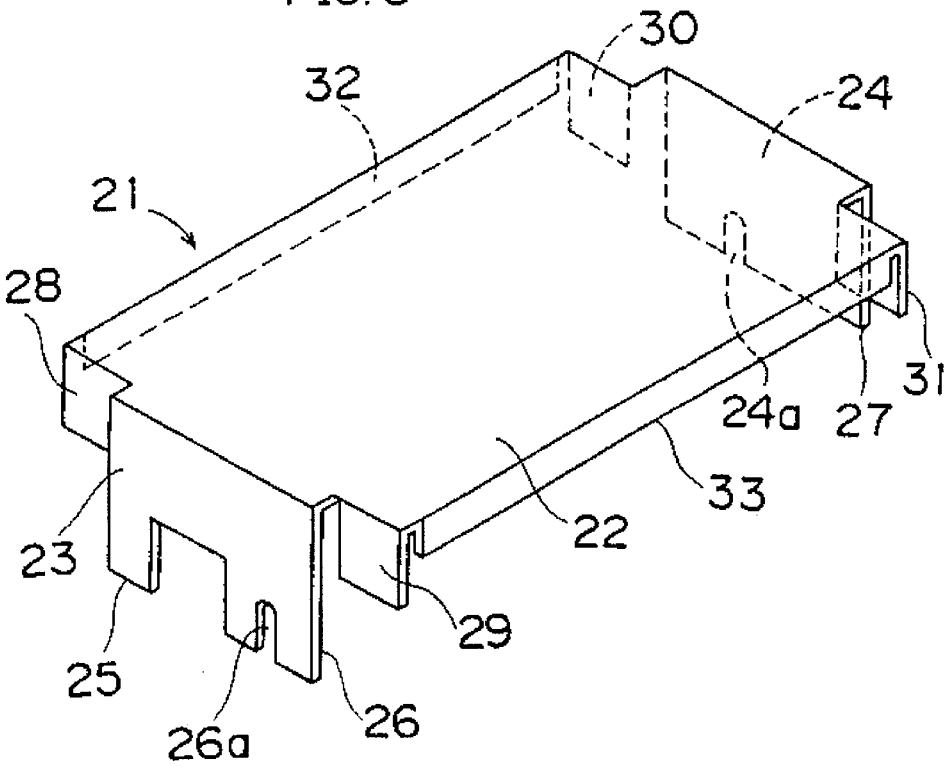
FIG. 5 is a perspective view showing a radiator which is employed in the first embodiment of the present invention.

FIG. 5 is a perspective view showing a radiator 21 which is employed for the antenna unit according to this embodiment. The radiator 21 is formed by bending a plate-type member consisting of a metal material such as copper or a copper alloy, as shown in FIG. 5. Alternatively, the radiator 21 may be made of another material, so far as the same has low conductor loss similarly to the aforementioned metal.

The radiator 21 is provided with a radiating part 22 having a rectangular plane shape. A first fixed part 23 is formed on one shorter side of the radiating part 22 to extend toward a dielectric substrate as described later. On another shorter side of the radiator 22, a second fixed part 24 is formed by bending. On a forward end of the first fixed part 23, a feed terminal 25 and a ground terminal 26 are integrally formed with the fixed part 23. On a forward end of the second fixed part 24, on the other hand, a capacitance connecting terminal 27 is integrally formed with the fixed part 24.

Further, stop members 28 and 29 as well as 30 and 31 are provided on both sides of the fixed parts 23 and 24, to be suspended shorter side edges of the radiating part 22 respectively.

On the other hand, longer side edges of the radiating part 22 are bent to form reinforcing members 32 and 33, in order to improve mechanical strength.

Figure 6:
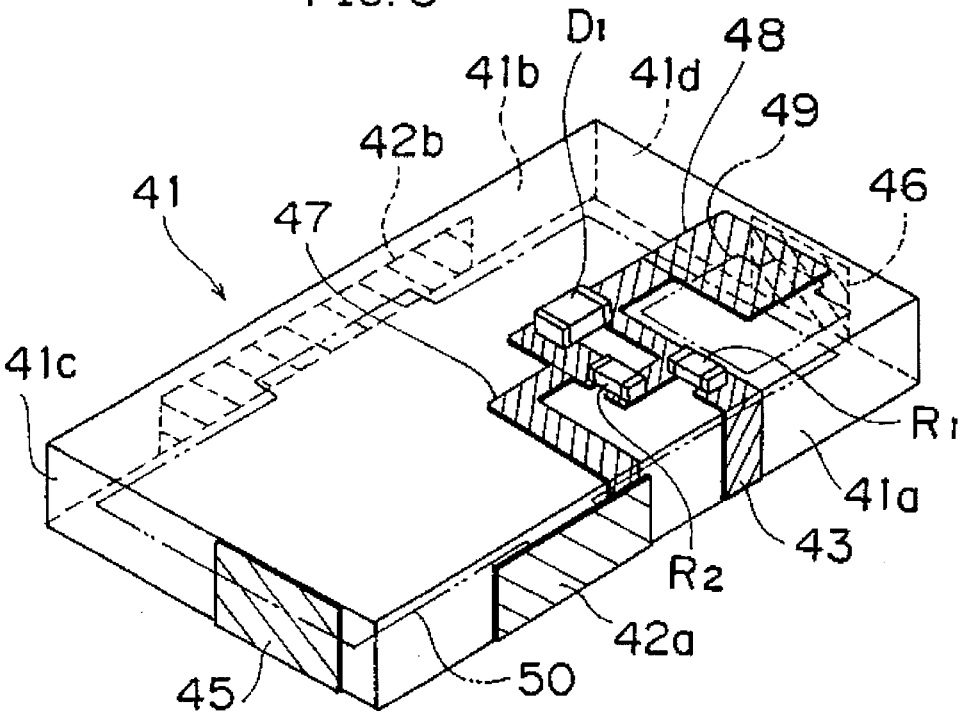
FIG. 6 is a perspective view showing a principal part of the antenna unit according to the first embodiment of the present invention.

FIG. 6 is a perspective view for illustrating a dielectric substrate 41 which is combined with the radiator 21 and parts which are mounted on the dielectric substrate 41. The dielectric substrate 41 is substantially in the form of a rectangular parallelepiped, as shown in FIG. 6. This dielectric substrate 41 can be made of a proper dielectric material such as dielectric ceramics or synthetic resin. According to this embodiment, the dielectric substrate 41 is prepared through a ceramics integral firing technique.

A ground electrode **42*a* and a terminal electrode 43 are formed on one longer side surface 41*a* of the dielectric substrate 41. The terminal electrode 43 corresponds to the aforementioned voltage input terminal 17. Another ground electrode 42*b* is formed on another side surface 41*b* which is opposed to the side surface 41*a***.

Further, a ground electrode 45 is formed on one shorter side surface **41*c* of the dielectric substrate 41 at a prescribed distance. A connecting electrode 46 is formed on another shorter side surface 41*d* of the dielectric substrate 41**.

A circuit pattern 47 is provided on the dielectric substrate 41 by forming a conductive film. Further, respective chip-type electronic components forming the diode $D_1$ and the resistances $R_1$ and $R_2$ shown in FIG. 4 are mounted and electrically connected with each other by the circuit pattern 47. Referring to FIG. 6, the chip-type electronic components forming the diode $D_1$ and the resistances $R_1$ and $R_2$ are denoted by these symbols.

Further, a capacitance deriving electrode 48 for forming a capacitor is formed on an upper surface of the dielectric substrate 41. The connecting electrode 46 provided on the side surface 41*d* is formed not to be electrically connected with the capacitance deriving electrode 48. As understood from a sectional view of FIG. 7 showing the portion provided with the capacitance deriving electrode 48, the capacitance deriving electrode 48 is formed not to be electrically connected with the connecting electrode 46 and not to reach edges of the dielectric substrate 41.

Another capacitance deriving electrode 49 is formed in an intermediate position of the interior of the dielectric substrate 41 to overlap with the capacitance deriving electrode 48 through the dielectric substrate layer, while a ground electrode 50 is formed in a position lower than the capacitance deriving electrode 49. Further, the capacitance deriving electrode 49 is drawn out on the side surface 41*d*, to be electrically connected with the aforementioned connecting electrode 46. On the other hand, the ground electrode 50 is so sized as to substantially reach the overall plane region of the dielectric substrate 41 in its lower portion, and electrically connected to the ground electrodes 42*a* and 42*b*.

Figure 7:
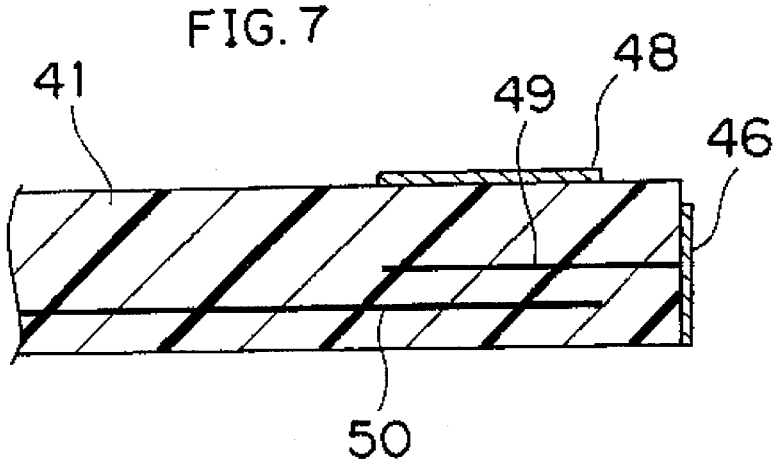
FIG. 7 is a partially fragmented sectional view for illustrating a capacitor which is formed in a dielectric substrate shown in FIG. 6.

As shown in FIG. 7, therefore, the capacitor $C_2$ shown in FIG. 4 is formed by the capacitance deriving electrodes 48 and 49. Further, a capacitor which is formed by the capacitance deriving electrode 49 and the ground electrode 50 defines a part of the capacitance $C_1$ provided in the antenna body 11 in the embodiment shown in FIG. 4.

Figure 8:
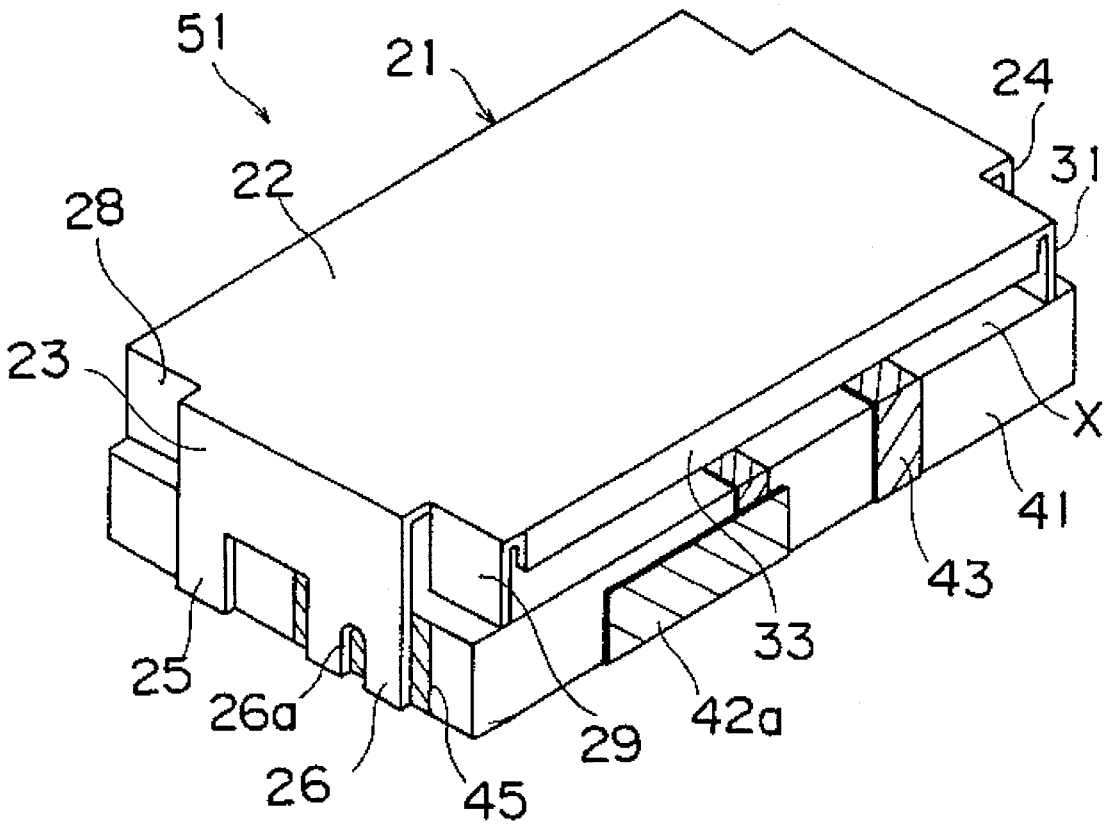
FIG. 8 is a perspective view showing the appearance of the antenna unit according to the first embodiment of the present invention.

In the antenna unit according to this embodiment, the radiator 21 is fixed to the dielectric substrate 41. In such fixation, the dielectric substrate 41 is inserted between the first and second fixed parts 23 and 24, so that the ground terminal 26 and the connecting terminal 27 are soldered to the ground electrode 45 and the connecting electrode 46 which are provided on the dielectric substrate 41. FIG. 8 is a perspective view showing the appearance of the antenna unit 51 according to this embodiment obtained in the aforementioned manner.

Slits 26*a* and 24*a* are formed in forward ends of the first and second fixed parts 23 and 24 of the radiator 21 shown in FIG. 5 respectively. These slits 24*a* and 26*a* serve as solder paste injection parts. Namely, it is possible to insert a forward end of a dispenser for applying solder paste from the slits 24*a* and 26*a*, so that the solder paste reliably adheres to the ground electrode 45 and the connecting electrode 46 of the dielectric substrate 41. When the fixed parts 23 and 24 are bonded to the dielectric substrate 41, therefore, the solder paste is reliably spread in the spaces between the fixed parts 23 and 24 and the side surfaces of the dielectric substrate 41 by heating, whereby it is possible to increase the bonding areas therebetween.

The slits 24*a* and 26*a* may be replaced by through holes which can receive the forward end of the solder paste dispenser.

As shown in FIG. 8, forward ends of the stop members 28, 29 and 31 are brought into contact with the upper surface of the dielectric substrate 41, and a space layer X of a prescribed thickness is defined between the radiating part 22 of the radiator 21 and the upper surface of the dielectric substrate 41 in the antenna unit 51 according to this embodiment.

Thus, the space layer X suppresses loss of radiated electric waves, thereby improving the gain of the antenna unit 51.

As hereinabove described, the feed terminal 25 serving as a feed part, the ground terminal 26 and the terminal electrode 43 for switching the capacitance of the capacitance means are formed on the side surfaces of the structure obtained by fixing the radiator 32 to the dielectric substrate 41, whereby the antenna unit 51 according to this embodiment can be surface-mounted on a printed circuit board by the bottom surface of the dielectric substrate 41.

In the miniature antenna unit 51 which can be surface-mounted on a printed circuit board, therefore, it is possible to switch its frequency band by applying a high- or low-level voltage from the terminal electrode 43.

Figure 9:
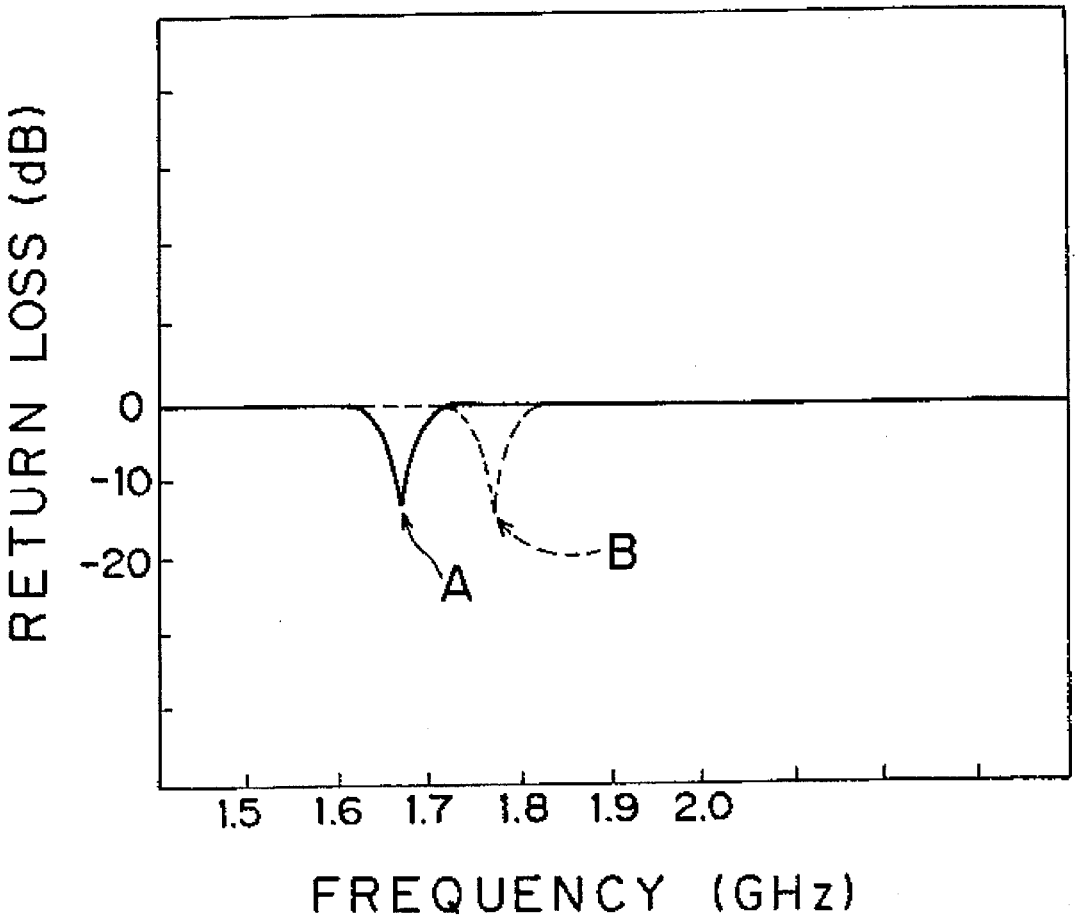
FIG. 9 illustrates reflection loss-frequency characteristics of the antenna unit according to the first embodiment of the present invention.

FIG. 9 shows reflection loss-frequency characteristics of the antenna unit 51.

In the reflection loss-frequency characteristics shown in FIG. 9, resonance points appear in a frequency position shown by arrow A, i.e., a position of 1.670 GHz, and a frequency position shown by broken arrow B, i.e., a position of 1.770 GHz. The resonance points shown by arrows A and B appear upon application of high- and low-level voltages from the terminal electrode 43 (the input terminal 17 in the circuit diagram shown in FIG. 4) respectively. The characteristics shown in FIG. 9 are attained when +3 V and −3 V are applied as high- and low-level voltages respectively with the resistance $R_1$ of 3.3 kO, the resistance $R_1$ of 47 kO, the capacitance $C_1$ of 1.0 pF, the capacitance of the capacitor $C_2$ of 0.5 pF, the electrostatic capacitance $C_X$ of the diode $D_l$ in an OFF state of 1.02 pF, and the total of the inductances $L_1$ and $L_2$ of 6.055 mH.

As clearly understood from FIG. 9, the resonance frequency of this antenna unit 51 is 1.670 GHz when a high-level voltage is applied from the terminal electrode 43, while the resonance frequency is switched to 1.770 GHz when a low-level voltage is applied from the terminal electrode 43. Therefore, this antenna unit 51 can be suitably applied to a mobile communication device having a transmission frequency of 1.670 GHz and a receiving frequency of 1.770 GHz.

Figure 10:
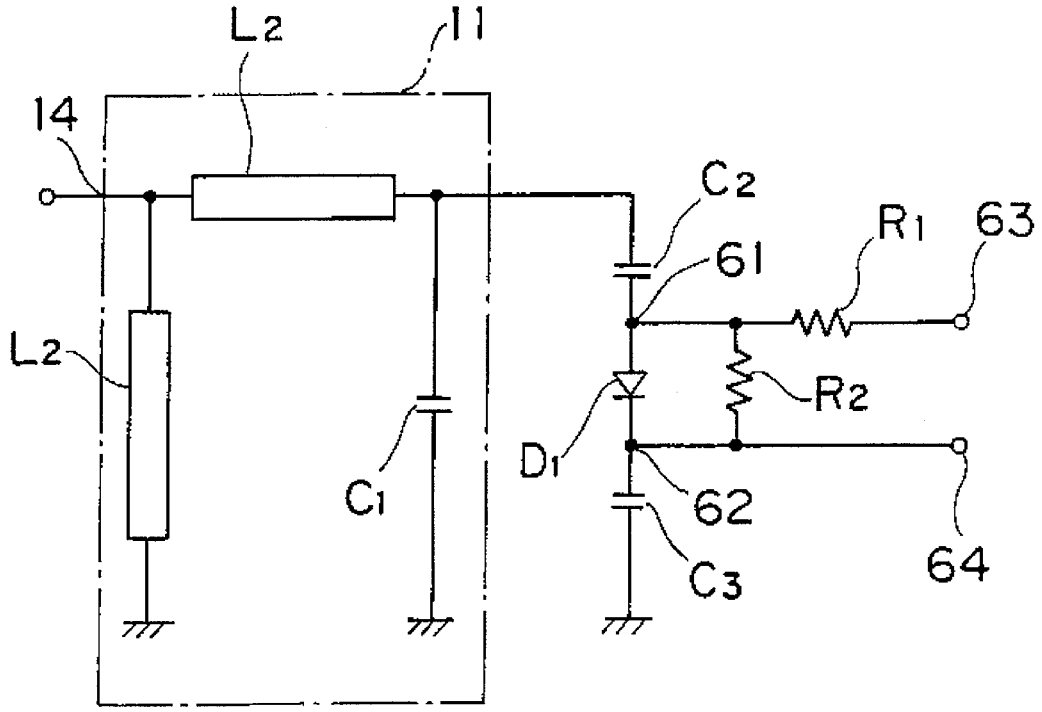
FIG. 10 is a circuit diagram of an antenna unit according to a second embodiment of the present invention.

FIG. 10 is a circuit diagram showing an antenna unit according to a second embodiment of the present invention. In the second embodiment, not only a first capacitor $C_2$ and a diode $D_1$ but a second capacitor $C_3$ is connected between an antenna body 11 and the ground potential in parallel with the capacitance $C_1$ of the antenna body 11. Namely, capacitance means is, formed by the first capacitor $C_2$, the diode $D_1$ and the second capacitor $C_3$ which are connected in series with each other. Further, a resistance $R_2$ is connected between a node 61 between the first capacitor $C_2$ and the diode $D_1$ and a node 62 between the diode $D_1$ and the second capacitor $C_3$ in parallel with the diode $D_1$, while a resistance $R_1$ is connected between the first node 61 and a pulse voltage supply terminal 63. Further, the second node 62 is connected to a second input terminal 64 for applying a pulse voltage.

In the antenna unit according to the second embodiment, voltages which are different in polarity from each other are applied to the pulse voltage input terminals 63 and 64. These voltages are so selected that the diode $D_1$ enters an ON state when a plus voltage is applied to the input terminal 63 and a minus voltage is applied to the input terminal 64. Thus, the diode $D_1$ enters an ON state when a plus voltage is applied to the input terminal 63 and a minus voltage is applied to the input terminal 64 as described above, Whereby the capacitance of the capacitance means is decided by those of the first and second capacitors $C_2$ and $C_3$.

In order to switch the resonance frequency of the antenna unit to increase the same, on the other hand, the voltages which applied to the input terminals 63 and 64 are inverted in polarity. Namely, a plus voltage and a minus voltage are applied to the input terminals 64 and 63 respectively, thereby bringing the diode $D_1$ into an OFF state. In this case, not only those of the first and second capacitors $C_2$ and $C_3$ but the capacitance of the diode $D_1$ in a nonconducting state is added to the capacitance of the capacitance means. Thus, it is possible to switch the resonance frequency of the antenna unit by inverting the voltages applied from the input terminals 63 and 64 in polarity, similarly to the first embodiment.

While voltages of different polarity are inputted in the first and second input terminals 63 and 64 in the second embodiment having the first and second input terminals 63 and 64 as hereinabove described, such input voltages can suitably be formed by outputs of a control unit controlling the antenna unit.

In the second embodiment, the second capacitor $C_3$ is adapted to separate the diode $D_1$ from the ground potential in application of the voltages of different polarity.

While each of the antenna units according to the first and second embodiments of the present invention has been described with reference to a structure of switching the resonance frequency of the antenna unit in two stages, the inventive antenna unit can also be formed so that its resonance frequency is switched in three or more stages. According to a third embodiment of the present invention shown in FIG. 11, for example, a plurality of the capacitance means and a plurality of the resonance frequency switching circuits shown in the first embodiment are connected to an antenna body 11, so that the resonance frequency can be switched in three or more stages. In the third embodiment shown in FIG. 11, each capacitance means and each resonance frequency switching circuit are similar to those of the first embodiment, and hence portions identical to those of the first embodiment are denoted by the same reference numerals, to omit redundant description.

Figure 11:
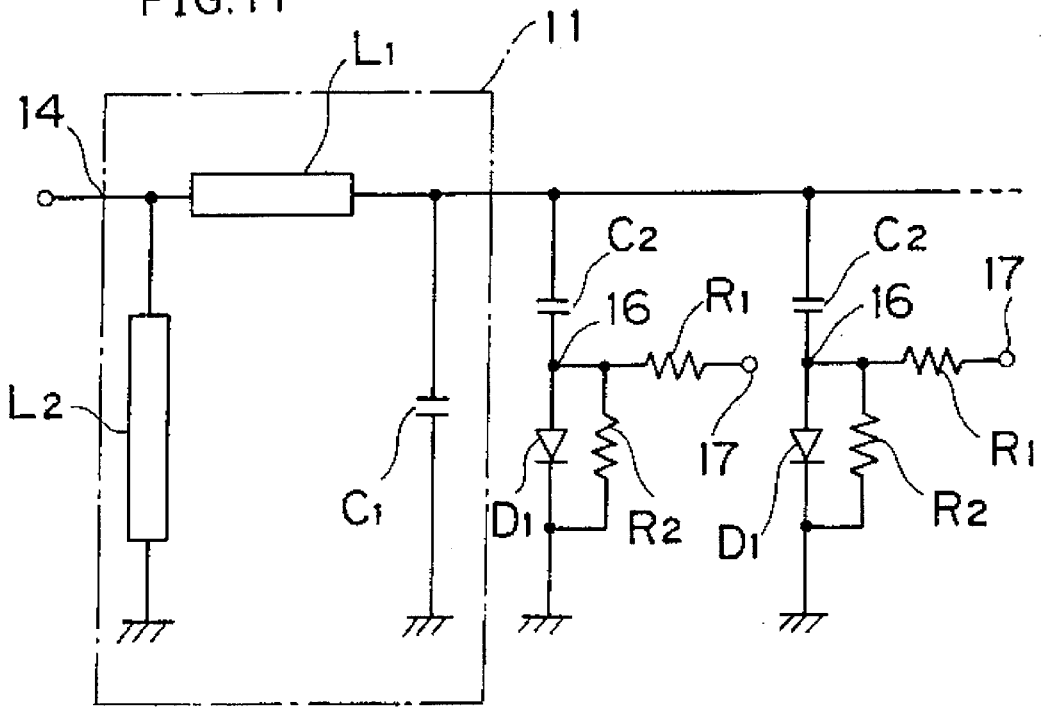
FIG. 11 is a circuit diagram of an antenna unit according to a third embodiment of the present invention.

When a plurality of capacitance means and a plurality of frequency switching circuits are connected to the antenna body 11, it is possible to switch the capacitances of the connected capacitance means in multiple stages, as clearly understood from FIG. 11. Thus, this antenna unit can be suitably applied to a communication device having a number of receiving frequencies, such as channels of a television receiver.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna unit comprising:

an antenna body having a feed part, and a part for being connected to ground potential;

capacitance means being connected between said antenna body and the ground potential, said capacitance means being in parallel with an electrostatic capacitance which is provided between said antenna unit and the ground potential, said capacitance means adding an additional capacitance to said electrostatic capacitance; and switching means for switching a value of said additional capacitance of said capacitance means for changing the resonance frequency of said antenna unit;

wherein said capacitance means has a first capacitor, a diode being connected in series with said first capacitor, and a second capacitor being connected in series with said diode, said switching means being a voltage supply circuit for supplying a first node between said first capacitor and said diode and a second node between said diode and said second capacitor with voltages being different in polarity from each other, said voltage supply circuit being formed to be capable of inverting said voltages being supplied to said first and second nodes in polarity.

2. An antenna unit in accordance with claim 1, wherein a plurality of resonance frequency switching circuits consisting of said capacitance means and said switching means are connected with respect to said antenna body.

3. An antenna unit in accordance with claim 1, wherein said antenna body comprises:

a dielectric substrate having upper, bottom and side surfaces, a ground electrode being formed on at least one of said side and bottom surfaces of said dielectric substrate, a radiator, consisting of a material having low conductor loss, being fixed to said dielectric substrate with one major surface opposed to said upper surface of said dielectric substrate, and a feed part being provided on at least one of said side and bottom surfaces of a laminate being formed by said dielectric substrate and said radiator.

4. An antenna unit in accordance with, claim 3, wherein said radiator comprises a radiating part having a rectangular plane shape and at least one fixed part extending from at least one side edge of said radiating part toward said dielectric substrate, said at least one fixed part being fixed to said side surface of said dielectric substrate, thereby fixing said radiator to said dielectric substrate.

5. An antenna unit in accordance with claim 4, wherein one major surface of said radiating part of said radiator is opposed to said upper surface of said dielectric substrate by a space layer of a prescribed thickness.

6. An antenna unit in accordance with claim 5, further comprising circuit elements being provided in said dielectric substrate and on said upper surface of said dielectric substrate for forming said capacitance means and said switching means.

7. An antenna unit in accordance with claim 1, wherein said capacitance means has a capacitor, and an element having a variable capacitance, said element and said capacitor being connected in series with each other, said switching means being connected to said variable-capacitance element, for changing said capacitance of said variable-capacitance element.

8. An antenna unit in accordance with claim 7, wherein said antenna body comprises:

a dielectric substrate having upper, bottom and side surfaces, a ground electrode being formed on at least one of said side and bottom surfaces of said dielectric substrate, a radiator, consisting of a material having low conductor loss, being fixed to said dielectric substrate with one major surface opposed to said upper surface of said dielectric substrate, and a feed part being provided on at least one of side and bottom surfaces of a laminate being formed by said dielectric substrate and said radiator.

9. An antenna unit in accordance with claim 8, wherein said capacitor is formed in said dielectric substrate.

10. An antenna unit in accordance with claim 7, wherein said variable-capacitance element is a diode, said switching means being a voltage supply circuit for supplying a node between said capacitor and said diode with a first or second voltage for bringing said diode into an ON or OFF state.

* * * * *